US005746110A

United States Patent [19]

Stoll

[11] Patent Number: 5,746,110

[45] Date of Patent: May 5, 1998

[54] DRIVE CYLINDER

[75] Inventor: Kurt Stoll, Esslingen, Germany

[73] Assignee: Festo KG, Esslinger, Germany

[21] Appl. No.: 802,067

[22] Filed: Feb. 19, 1997

[30] Foreign Application Priority Data

Feb. 20, 1996 [DE] Germany ..... 196 06 220.9

[51] Int. Cl.[6] ..... F01B 31/14

[52] U.S. Cl. ..... 92/13.6; 92/108; 92/110; 92/112

[58] Field of Search ..... 92/109, 110, 111, 92/112, 164, 13.6, 107, 108

[56] References Cited

U.S. PATENT DOCUMENTS

| | | | |
|---|---|---|---|
| 3,858,485 | 1/1975 | Rosaen et al. | 92/108 |
| 4,242,947 | 1/1981 | Renner et al. | 92/164 |
| 4,791,854 | 12/1988 | Banicevic | 92/108 |
| 4,899,642 | 2/1990 | Hwang | 92/109 |

FOREIGN PATENT DOCUMENTS

| | | |
|---|---|---|
| GM 19 89 292 | 3/1968 | Germany . |
| 195 04 207 A1 | 10/1985 | Germany . |
| 35 06 380 A1 | 8/1986 | Germany . |

*Primary Examiner*—Thomas E. Denion
*Attorney, Agent, or Firm*—Hoffmann & Baron, LLP

[57] ABSTRACT

A compact drive cylinder with a cylinder barrel, an end cap and a guide cap is provided. In the cylinder barrel an axially sliding piston is arranged, on which a piston rod is mounted which extends through the guide cap. The piston divides a thrust chamber off in a fluid-tight manner chamber from a return chamber, the thrust chamber being connected with a thrust chamber port and the return chamber being connected with a return chamber port respectively in a fluid-tight fashion. Both the thrust chamber port and also the return chamber port are arranged in the end cap. An axially extending abutment rod having an abutment extends through the end cap and has its internal end extending through the piston into the return chamber so that an abutment for the piston is located in the return chamber. The piston is able to be slid a distance H axially on the abutment rod and is guided in a sealed manner; the abutment rod possesses a cavity, via which the return chamber is connected with the return chamber port for fluid flow therebetween.

12 Claims, 1 Drawing Sheet

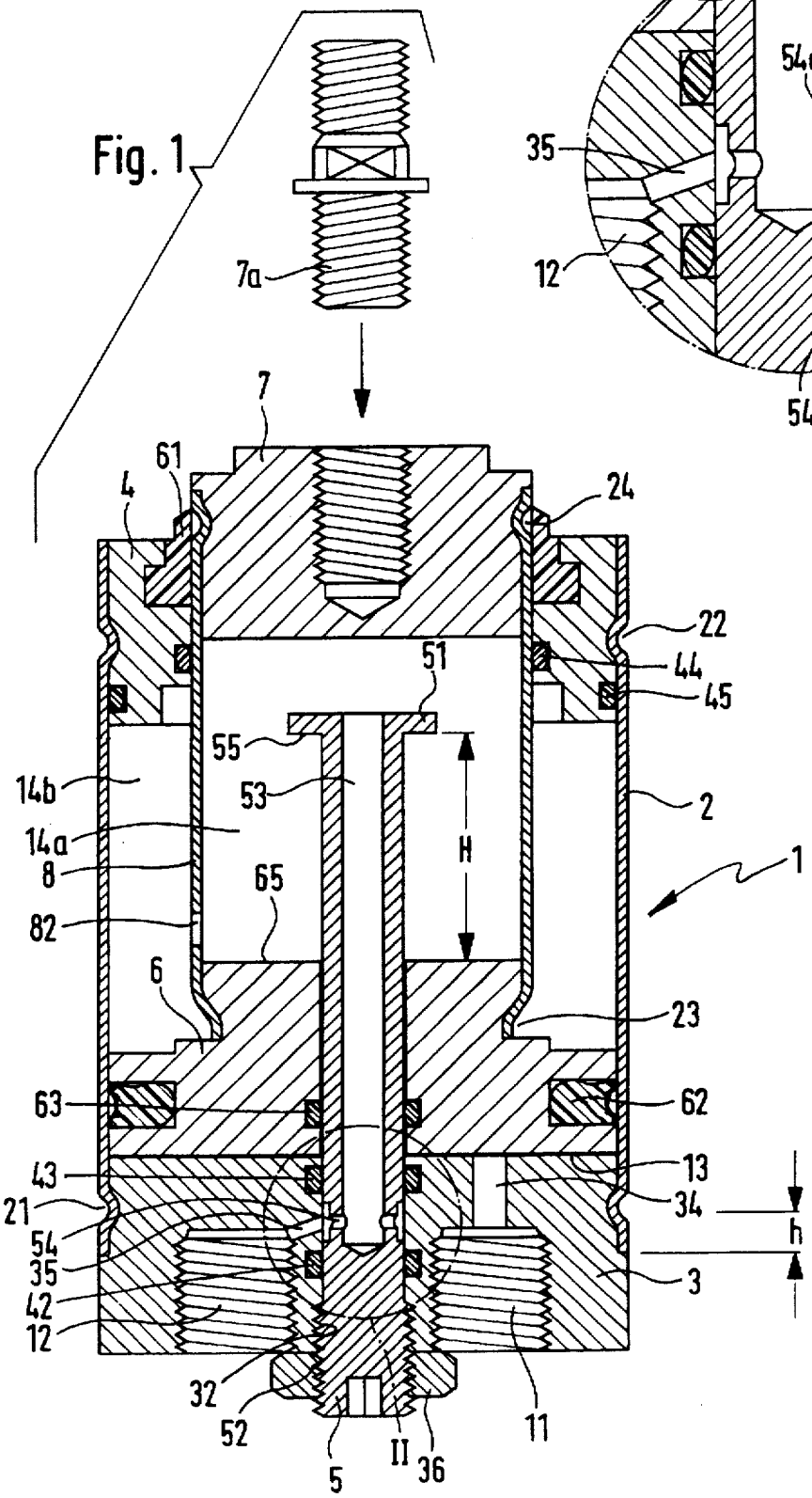
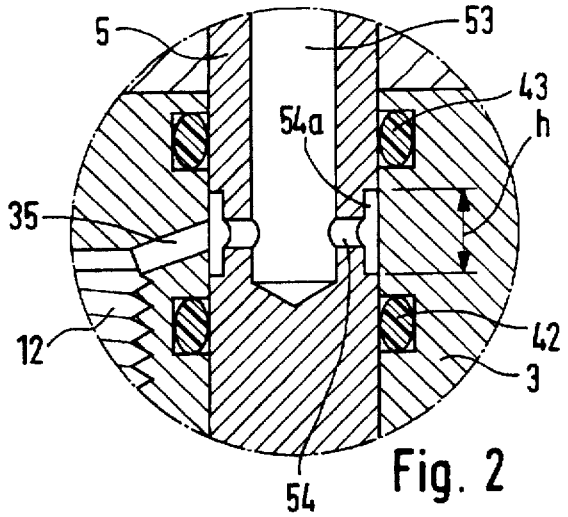
Fig. 2

DRIVE CYLINDER

BACKGROUND OF THE INVENTION

The invention relates to a drive cylinder comprising a cylinder barrel, an end cap attached to the one end region of the cylinder barrel, a guide cap attached to the other end region of the cylinder barrel, a piston adapted to slide in the cylinder barrel axially and a piston rod connected with the piston and extending through the guide cap and guided thereby, the axially sliding piston dividing off a thrust chamber and a return chamber in a fluid tight manner from one another, the thrust chamber being connected with a thrust chamber port and the return chamber being connected with a return chamber port in fluid conducting manner.

THE PRIOR ART

Such drive cylinders are known in the art, see for instance the German patent publication 3,507,167 C2. In the case of such conventional drive cylinders it is however usual for the ports for the supply of drive fluid into the thrust chamber and into the return chamber of the drive cylinder to be arranged on different ends or sides of the drive cylinder. Most usually the thrust chamber port, for instance, is located on the end cap and the return chamber fluid port is arranged on the peripheral surface or on the guide cap of the drive cylinder. These ports and the fluid lines running to them may cause interference in many applications for the drive cylinder. More particularly lateral ports on the peripheral surface of the cylinder impede operation in corners or narrow channels.

SHORT SUMMARY OF THE INVENTION

Accordingly one object of the present invention is to provide a drive cylinder of the type initially mentioned, which possesses a more compact structure without loss of functionality and is cheap to manufacture.

This object is to be attained by a drive cylinder in which both the thrust chamber port and also the return chamber port are arranged in the end cap; in which an axially extending abutment rod with an abutment extends through the end cap, with which it is connected in an axially fixed fashion and has its inner end extending right through the piston into the return chamber so that an abutment for the piston is located in the return chamber, the piston being able to be axially slid in relation to the abutment rod along a stroke H while being sealed; and in which the abutment rod possesses a cavity, via which the return chamber is connected with the return chamber port for flow of fluid therebetween.

Owing to the particular arrangement of the two fluid ports in the end cap of the drive cylinder and the use of the abutment rod both as an abutment for the piston and also as part of the drive fluid line leading to the return chamber a compact structure with only a few components is rendered possible. With the exception of the end cap all the principal parts of the drive cylinder may be practically exclusively parts with cylindrical symmetry, which may be easily produced by turning or simply cut off from runing lengths of stock of indefinite length and then assembled as the drive cylinder of the invention.

Further advantageous developments of the invention are defined in the claims.

The abutment for the piston is preferably so designed that it consists of an abutment shoulder arranged on the internal end of the abutment rod, which is opposite to the surface, facing the return chamber, of the piston. This means that the force, which is exerted on impact of the piston against the abutment, is distributed over an area and the piston is additionally guided during its entire stroke by the abutment rod.

It is more particularly an advantage if the cavity in the abutment rod is made up of an axial abutment rod channel, which opens into the return chamber at the internal end and of a substantially radial passage, which joins the axial abutment channel with the return chamber port for flow of fluid. Accordingly the cylindrical symmetry of the abutment rod is adhered to with the exception of the radial passage. Furthermore there is all in all a reduction in weight of the drive cylinder without any substantial decrease in the structural strength of the abutment rod.

In order to facilitate manufacture and to increase its strength the abutment as such of the abutment rod is preferably in the form of a flange-like widened part at the inner end of the abutment rod about the opening of the abutment rod channel.

In accordance with a particularly preferred form of the invention the axially fixed connection of the abutment rod with the end cap is able to be adjusted along a path h in an axial direction, it being more particularly possible to provide a screw thread connection between the end cap and the abutment rod, which is fixed in place by means of a lock nut, which is mounted on the part, projecting from the end cap, of the abutment rod and is thrust against the external surface of the end cap.

It is preferred for the return chamber port to possess a substantially radial passage in the end cap, which is in register independently of the axial setting of the connection with the passage from the cavity in the abutment rod. For this purpose the passage is preferably expanded at the outer peripheral surface of the abutment rod to form an annular groove, whose axial extent is at least as large as the stroke h. This ensures that for the entire distance or range h of stroke adjustment there is a fluid connection between the passage of the cavity in the abutment rod and the passage in the end cap.

Axially on each side of the above mentioned passages there is preferably a respective seal, extending in the peripheral direction relative to the abutment rod, for providing a fluid-tight sealing action in the transitional region between the passage in the abutment rod and the passage in the end cap. This means that when the return chamber is put under pressure by the drive fluid there is no escape of drive fluid into the surroundings or into the thrust chamber which is at the moment not being put under pressure.

In accordance with a particularly preferred development of the invention the return chamber comprises a first chamber part defined by the piston, the piston rod rod and the coupling member and a second chamber part, which is concentric to the first chamber, defined by the piston, the cylinder barrel and the guide cap, the two chambers being connected together by a pas[sa]ge in the piston rod. This ensures that when the drive fluid is acting in the return chamber, the drive fluid is presented with a effective piston area, which, less the cross sectional area of the piston rod, is the same in size as the effective piston area on the thrust chamber side.

An extremely inexpensive embodiment is characterized in that on the one hand the end cap and the guide cap together with the cylinder barrel and on the other hand the piston and the coupling member are connected with the piston rod by means of corrugations or grooves.

Further advantages, features and possibilities of use of the invention will be understood from the following description of a preferred embodiment thereof in conjunction with the drawings.

LIST OF THE SEVERAL VIEWS OF THE FIGURES

FIG. 1 shows a preferred design of the drive cylinder of the invention in a longitudinal section.

FIG. 2 shows a part II of FIG. 1 on a larger scale.

DETAILED ACCOUNT OF WORKING EMBODIMENT OF THE INVENTION

In FIG. 1 the fluid driven cylinder 1 of the invention is illustrated in longitudinal section. The piston 6 connected by means of the piston rod 8 with a coupling member 7 is able to move axially in the cylinder barrel 2, which at its ends is closed by a guide cap 4 and an end cap 3 respectively. The coupling member 7 serves to receive a coupling 7*a* for a component to be moved (not illustrated). In the figure the piston is just in its retracted position so that the thrust chamber 13 has its minimum volume, whereas the return chamber, comprising two separate chamber parts 14*a* and 14*b*, concentric to one another, is at its maximum volume. Between the two chamber parts 14*a* and 14*b* of the return chamber there is a passage 82 in the sleeve-like or, respectively, tubular piston rod 8. The piston stroke H is set by a flange-like abutment 51 having an abutment surface 55. The abutment is located at the end of an abutment rod 5 extending into the chamber part 14*a* of the return chamber. The thrust chamber port 11 and the return chamber port 12 are both arranged in the end cap 3 and have as their main part an internal screw thread, into which the ends of the respective pressurized fluid line (not illustrated) are screwed. It is however possible to employ, for example, plug-in connections for the connection of the fluid line with the end cap 3 of the drive 1.

This space-saving arrangement of the return chamber port 12 in the end cap 3 alongside the thrust chamber port 11 is rendered possible because the abutment rod 5 extends through the end cap 3 in the axial direction and for its part has a cavity extending through it, which comprises an axially extending abutment rod channel 53, which extends along a considerable part of the length of the abutment rod 5 and opens at the abutment end of the abutment rod 5 into the chamber part 14*a* of the return chamber, and because the radial passages 54 and 35 in the abutment rod 5 and, respectively, the end cap 3 produce the fluid connection between the return chamber port 12 and the channel 53. The passage 54 and/or the passage 35 are in this respect flared out at their mutually adjacent ends so that even in the case of an axial movement, performed for adjustment of the stroke, of the abutment rod 5 the fluid connection via the two passages 54 and 35 is maintained. Since, in the present working embodiment, rod adjustment is performed using an internal screw thread 32 in the end cap 3 and an external screw thread 52 on the abutment rod 5 by turning the abutment rod 5 in the end cap 3, the widened or outwardly flared part possesses the form of an annular groove 54*a* in the peripheral surface of the abutment rod 5 opposite to the passage 35 in the end cap (see FIG. 2). The axial width of the annular groove 54*a* is in this case equal to the adjustment range h for the piston stroke H. Using a lock nut 36 on the end extending from the end cap 3 the stroke setting may be made permanent.

Together with the cylindrical surface 2 and the internal peripheral surface of the guide cap 4, the external peripheral surface of the abutment rod 5 serves to guide the piston 6 and the piston rod 8 connected to same. For this purpose there are also seals and/or strippers 61, 62 and 63 arranged in the guide cap 4 and in the piston 6. For sealing off the chambers and for attachment of the cylinder barrel 2 and of the hollow piston rod 8 synthetic sealing rings 44 and 45 are employed in combination with grooves or corrugations 21, 22, 23 and 24. In this respect the grooves perform a firmly joining function with a permanent set. They are instrumental in making economic manufacture of the drive cylinder possible. Via the passage 82 the two chamber parts 14*a* and 14*b* of the return chamber 82 are connected with one another. This ensures that for the return movement as well a large area is available for the piston to be acted upon by the fluid under pressure. The two sealing rings 42 and 43 ensure that no fluid under pressure can escape between the peripheral surface of the abutment rod 5 and the internal peripheral surface of the end cap 3.

During operation of the drive cylinder 1, for advance of the piston, the thrust chamber 13 is supplied with fluid under pressure via the thrust chamber port 11 and a passage 34, whereas fluid in the return chamber 14*a* and 14*b* is expelled via the abutment rod channel 53, the radial passage 54 and also the passage 35 and the return chamber connection 12. Conversely, during return motion of the piston 6, the return chamber 14*a* and 14*b* is supplied with fluid via the same path as that employed for expulsion, and fluid is expelled from the thrust chamber 13. For this purpose an external controller for the flows of fluid is required in the fluid supply ducts (not illustrated). As the pressurized fluid use is preferably made of compressed air.

FIG. 2 shows the section II marked in a circle in FIG. 1 on a larger scale. The passage 35, which extends substantially radially and obliquely upward through the end cap opens into the annular groove 54*a* in the radial passage 54 in the abutment rod 5. On either side of the annular groove this transitional part is sealed off for fluid under pressure by annular seals 42 and 43. The annular groove 54*a* possesses an axial width at least equal to h and renders possible setting of the stroke H over a range h by screwing the abutment rod 5 inward and outward.

I claim:

1. A drive cylinder comprising a cylinder barrel, an end cap attached to a first end region of the cylinder barrel, a guide cap attached to a second end region of the cylinder barrel, a piston adapted to slide in the cylinder barrel axially and a piston rod connected with the piston and extending through the guide cap and guided thereby, the axially sliding piston dividing off a thrust chamber and a return chamber in a fluid tight manner from one another, the thrust chamber being connected with a thrust chamber port and the return chamber being connected with a return chamber port in a fluid conducting manner, characterized in that both the thrust chamber port and also the return chamber port are arranged in the end cap; in that an axially extending abutment rod having an abutment, the abutment rod extending through the end cap with which it is connected in an axially fixed fashion and the abutment rod being axially adjustable along an axial distance h, the abutment rod has its inner end extending through the piston into the return chamber so that the abutment is located in the return chamber, the piston being able to be axially slid in relation to the abutment rod along a stroke while being sealed; and in that the abutment rod possesses a cavity, via which the return chamber is connected with the return chamber port for flow of fluid there between.

2. The drive cylinder as claimed in claim 1, characterized in that the abutment comprises an abutment shoulder, having an abutment surface, arranged on the internal end of the abutment rod, such abutment surface being opposite to the surface, facing the return chamber, of the piston.

3. The drive cylinder as claimed in claim 1, characterized in that the cavity in the abutment rod comprises an axial abutment rod channel, which opens at the internal end of the abutment rod into the return chamber, and an essentially radial passage, which provides a fluid flow connection between the axial abutment rod channel and the return chamber port.

4. The drive cylinder as claimed in claim 2, characterized in that the abutment shoulder is in the form of a flange-like widened part of an inner end, located in the return chamber, of the abutment rod around an opening of the abutment rod channel.

5. The drive cylinder as claimed in claim 1 characterized in that the axially fixed connection is a screw join, which is locked by means of a lock nut mounted on the part projecting from the end cap of the abutment rod and acting with a thrust against the external surface of the end cap.

6. The drive cylinder as claimed in claim 1 characterized in that the return chamber port possesses a substantially radial passage in the end cap, which passage is in communication, independently of the axial setting of the connection, with the cavity of the abutment rod.

7. The drive cylinder as claimed in claim 6, characterized in that the passage on an external peripheral surface of the abutment rod is widened out in the form of an annular groove, whose axial extent is a at least equal to a distance h.

8. The drive cylinder as claimed in claim 6, characterized in that axially on either side of the passage a seal is provided extending in the peripheral direction of the abutment rod in order to provide a fluid-tight sealing action between the abutment rod and the end cap.

9. The drive cylinder as claimed in claim 1, characterized in that the return chamber is made up of a first chamber defined by the piston, the piston rod and a coupling.

10. The drive cylinder as claimed in claim 1, characterized in that on the one hand the end cap and the guide cap with the cylinder barrel and on the other hand the piston and the coupling member are connected with the piston rod by means of corrugations.

11. A drive cylinder comprising:

a cylinder barrel having a first and second end;

an end cap attached to a first end of the cylinder barrel;

a guide cap attached to a second end of the cylinder barrel;

a piston adapted to axially slide within the cylinder barrel, the piston dividing off a thrust chamber and a return chamber from one another, the thrust chamber being connected with a thrust chamber port and the return chamber being connected with a return chamber port in a fluid conducting manner, the thrust chamber port and the return chamber port being arranged in the end cap;

a piston rod connected to the piston and extending through the guide cap, an axially extending abutment rod having an abutment formed on an inner end thereof, the inner end extending through the piston into the return chamber, the abutment rod extending through the end cap and being connected thereto in an axially fixed fashion, the abutment rod being adjustable along an axial extent for adjusting the axial movement of the piston, the abutment rod further including a passage providing a fluid connection between the return chamber port and the return chamber.

12. A drive cylinder comprising:

a cylinder barrel having a first and second end;

an end cap attached to a first end of the cylinder barrel;

a guide cap attached to a second end of the cylinder barrel;

a piston adapted to axially slide in the cylinder barrel;

a piston rod connected to the piston and extending through the guide cap, the piston dividing off a thrust chamber and a return chamber in a fluid tight manner from one another, the thrust chamber being connected with a thrust chamber port and the return chamber being connected with a return chamber port in a fluid conducting manner, the thrust chamber port and the return chamber port being arranged in the end cap;

an axially extending abutment rod having an abutment formed on an inner end thereof, the abutment rod extending through the end cap and being connected thereto in an axially fixed fashion, the abutment rod inner end extending through the piston into the return chamber, the piston being axially slidable relative to the abutment rod, the abutment rod having a cavity through which the return chamber is fluidly connected to the return chamber port, and the return chamber port being axially offset from the abutment rod; and the end cap having a radially extending passage providing a fluid connection between the axial abutment rod channel and the return chamber port.

* * * * *